US008328170B2

(12) United States Patent
Wasinger

(10) Patent No.: US 8,328,170 B2
(45) Date of Patent: Dec. 11, 2012

(54) CLAMPING APPARATUS

(75) Inventor: Eric M. Wasinger, Bexar County, TX (US)

(73) Assignee: Toyota Motor Engineering & Manufacturing North America , Inc., Ann Arbor, MI (US)

( * ) Notice: Subject to any disclaimer, the term of this patent is extended or adjusted under 35 U.S.C. 154(b) by 683 days.

(21) Appl. No.: 12/488,513

(22) Filed: Jun. 19, 2009

(65) Prior Publication Data

US 2010/0320663 A1 Dec. 23, 2010

(51) Int. Cl.
*B25B 11/00* (2006.01)

(52) U.S. Cl. ..... 269/8; 269/90; 269/216; 269/3; 269/6

(58) Field of Classification Search ..... 269/8, 90, 269/216, 3, 6; 29/268, 270, 244; 81/409, 81/367, 418–424, 368–371
See application file for complete search history.

(56) References Cited

U.S. PATENT DOCUMENTS

| | | | | | |
|---|---|---|---|---|---|
| 1,686,640 | A | * | 10/1928 | Pierce, Jr | 29/221.5 |
| 1,977,903 | A | * | 10/1934 | Von Wolforsdorf | 30/410 |
| 3,417,752 | A | * | 12/1968 | Butler | 606/147 |
| 3,425,468 | A | * | 2/1969 | Soucy | 81/489 |
| 3,585,704 | A | * | 6/1971 | Schroeder | 29/235 |
| 4,291,855 | A | | 9/1981 | Schenkel et al. | |
| 4,315,447 | A | * | 2/1982 | Tartaglia et al. | 81/421 |
| 5,014,578 | A | | 5/1991 | Flentge | |
| 5,243,883 | A | * | 9/1993 | Savage | 81/421 |
| 5,417,701 | A | * | 5/1995 | Holmes | 606/148 |
| 5,902,015 | A | * | 5/1999 | Allcock | 297/463.1 |
| 5,957,430 | A | * | 9/1999 | Olson | 254/28 |
| 6,095,019 | A | * | 8/2000 | Warheit et al. | 81/370 |
| 6,175,998 | B1 | * | 1/2001 | Leo | 29/268 |
| 6,311,588 | B1 | | 11/2001 | St. John et al. | |
| 6,487,942 | B1 | * | 12/2002 | Carter et al. | 81/426.5 |
| 6,966,244 | B2 | * | 11/2005 | Herbst et al. | 81/418 |
| 7,322,088 | B2 | * | 1/2008 | Sullivan et al. | 29/268 |
| 7,373,862 | B2 | * | 5/2008 | Tyler | 81/367 |
| 7,399,101 | B2 | * | 7/2008 | Clausen et al. | 362/119 |
| 7,587,800 | B2 | * | 9/2009 | Dasbach et al. | 29/267 |
| 7,959,140 | B2 | * | 6/2011 | Wong et al. | 269/8 |
| 2005/0217118 | A1 | * | 10/2005 | Mah | 30/261 |
| 2005/0274237 | A1 | * | 12/2005 | Winkler | 81/367 |
| 2008/0257120 | A1 | * | 10/2008 | Tsai | 81/418 |
| 2010/0213657 | A1 | * | 8/2010 | Sladojevic | 269/8 |
| 2010/0223770 | A1 | * | 9/2010 | Jenks | 29/214 |

* cited by examiner

*Primary Examiner* — George Nguyen
(74) *Attorney, Agent, or Firm* — Garrana Tran LLP; Andrea E. Tran

(57) ABSTRACT

A clamping apparatus is disclosed including a first handle defining a hole, a magnet affixed to the first handle, and a movable jaw coupled to the first handle and a second handle, the jaw comprising two clamp segments. The apparatus further includes a magnet contacting element disposed on a release lever on the second handle, wherein pressure is applied to release the release lever from contacting the magnet in an open position.

20 Claims, 3 Drawing Sheets

CLAMPING APPARATUS

TECHNICAL FIELD

The present disclosure relates generally to the field of clamping apparatus, and more specifically, to securing clamping apparatus in a clamping position.

BACKGROUND

A clamping apparatus may be a type of tool used in the manufacturing industry to hold and move parts during the building or assembly process. Various types of clamping apparatus, including clamps and pliers, may be utilized in the automotive manufacturing process, for example, to clamp heavy objects, such as axles of an automobile, while on a manufacturing assembly.

Over the years, numerous improvements have been made to the conventional clamping apparatus to obtain a more efficient and secure apparatus, particularly when in the clamping position. Some clamping apparatus may include a locking device such as a toggle, for example, to secure a part within the clamping apparatus. However, current locking devices may not provide for extra stabilization when a relatively heavy object, such as an axle on an automotive assembly line, is being clamped. Further, current locking devices on clamping apparatus may not provide an efficient means for a user to secure a clamping apparatus in a clamping position or release such an apparatus from the clamping position to an open position.

Thus, a need exists for improved apparatus for efficiently securing a clamping apparatus in a clamping position and easily allowing the release of such an apparatus from the clamping position to an open position.

SUMMARY

The following presents a general summary of several aspects of the disclosure in order to provide a basic understanding of at least some aspects of the disclosure. This summary is not an extensive overview of the disclosure nor is it intended to identify key or critical elements of the disclosure or to delineate the scope of the claims. The following summary merely presents some concepts of the disclosure in a general form as a prelude to the more detailed description that follows.

One aspect of the present disclosure provides for a clamping apparatus including a first handle defining a hole, a magnet affixed to the first handle, and a movable jaw coupled to the first handle and a second handle, the jaw comprising two clamp segments. The apparatus further includes a magnet contacting element disposed on a release lever on the second handle, wherein pressure is applied to release the release lever from contacting the magnet in an open position.

Another aspect of the present disclosure provides for a clamping apparatus including a first handle defining a hole, a magnet affixed to the first handle to secure the clamping apparatus in a clamping position, and a movable jaw coupled to the first handle, the jaw comprising two clamp segments, wherein each of the two clamp segments comprise an end portion with a substantially semi-circular cross-sectional surface. The clamping apparatus further includes a release lever coupled to the movable jaw, the release lever in contact with the magnet in the clamping position and wherein pressure is applied to release the release lever from contacting the magnet in an open position.

A further aspect of the present disclosure provides for a clamping apparatus including a first handle defining a hole, a magnet affixed to the first handle, and a movable jaw coupled to the first handle and a second handle, the jaw comprising two clamp segments. The clamping apparatus further includes a magnet contacting element disposed on a release lever on the second handle, wherein the magnet contacting element is engaged with the magnet to secure the clamping apparatus in a clamping position.

BRIEF DESCRIPTION OF THE DRAWINGS

For detailed understanding of the present disclosure, references should be made to the following detailed description of the several aspects, taken in conjunction with the accompanying drawings, in which like elements have been given like numerals and wherein.

DETAILED DESCRIPTION

Figure 1:
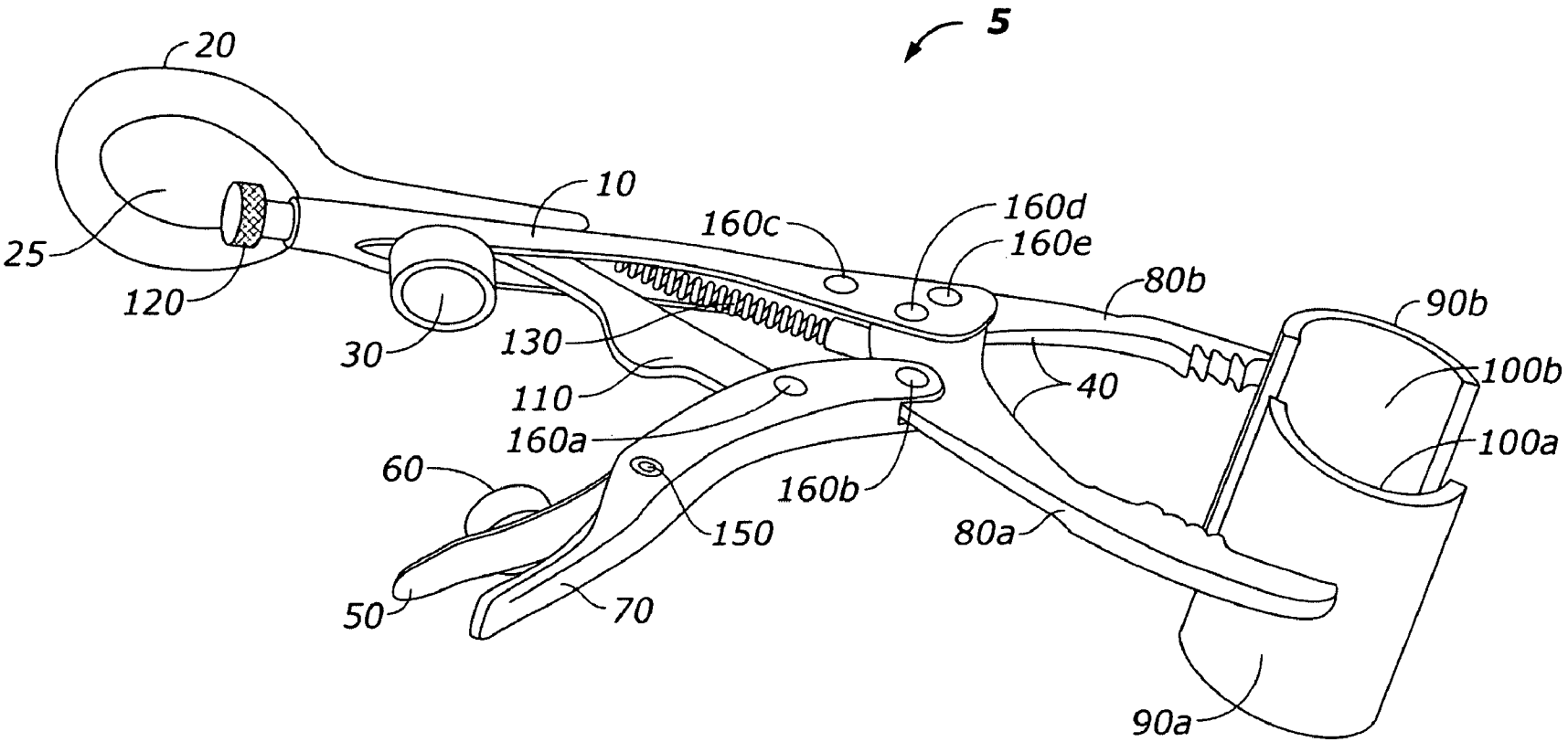
FIG. 1 represents an isometric view of a clamping apparatus in accordance with one aspect of the present disclosure.

Before the present apparatus are described, it is to be understood that this disclosure is not limited to the particular apparatus described, as such may vary. One of ordinary skill in the art should understand that the terminology used herein is for the purpose of describing possible aspects, embodiments and/or implementations only, and is not intended to limit the scope of the present disclosure which will be limited only by the appended claims.

It must also be noted that as used herein and in the appended claims, the singular forms "a," "an," and "the" may include plural referents unless the context clearly dictates otherwise. Thus, for example, reference to "a clamp" may refer to one or several clamps and reference to "a method of lifting" includes reference to equivalent steps and methods known to those skilled in the art, and so forth.

This disclosure is not limited in its application to the details of construction and the arrangement of components set forth in the following description or illustrated in the drawings. The disclosure is capable of other embodiments, implementations or aspects and of being practiced or of being carried out in various ways. Also, the use of "including," "comprising," "having," "containing," "involving," "consisting" and variations thereof, is meant to encompass the items listed thereafter and equivalents thereof as well as additional items.

FIG. 1 represents an isometric view of a clamping apparatus, generally indicated at 5, in accordance with one aspect of the present disclosure. The clamping apparatus 5 may be made of suitable rigid material including, but not limited to, metal, metal alloy, steel, aluminum, or the like. As shown, the clamping apparatus 5 may include a handle 10 coupled to a release lever 50 and a movable jaw 40 comprising clamp segments 80*a*, 80*b*. It should be understood that the present disclosure has applicability to clamping apparatus 5 as broadly described herein, and is not intended to be limited to the clamping apparatus 5 or its elements specifically described.

The handle 10 includes an elongated body which provides a surface onto which the palm of a user may contact and/or grip the clamping apparatus 5. The handle 10 may define additional features such as grooves or elements to facilitate the gripping of the clamping apparatus 5, which may not be shown in FIG. 1. In one implementation, the handle 10 may be pivotally fixed to the movable jaw 40 via a connecting means such as fasteners 160*b*-160*e*. An elastic member 130 may further interconnect the handle 10 to the movable jaw 40, providing a means for which the handle 10 can move relative to a release lever 50 or secondary handle 70 (to be described below) from a first position, such as an open position, to a second position, such as a clamping position.

Figure 3:
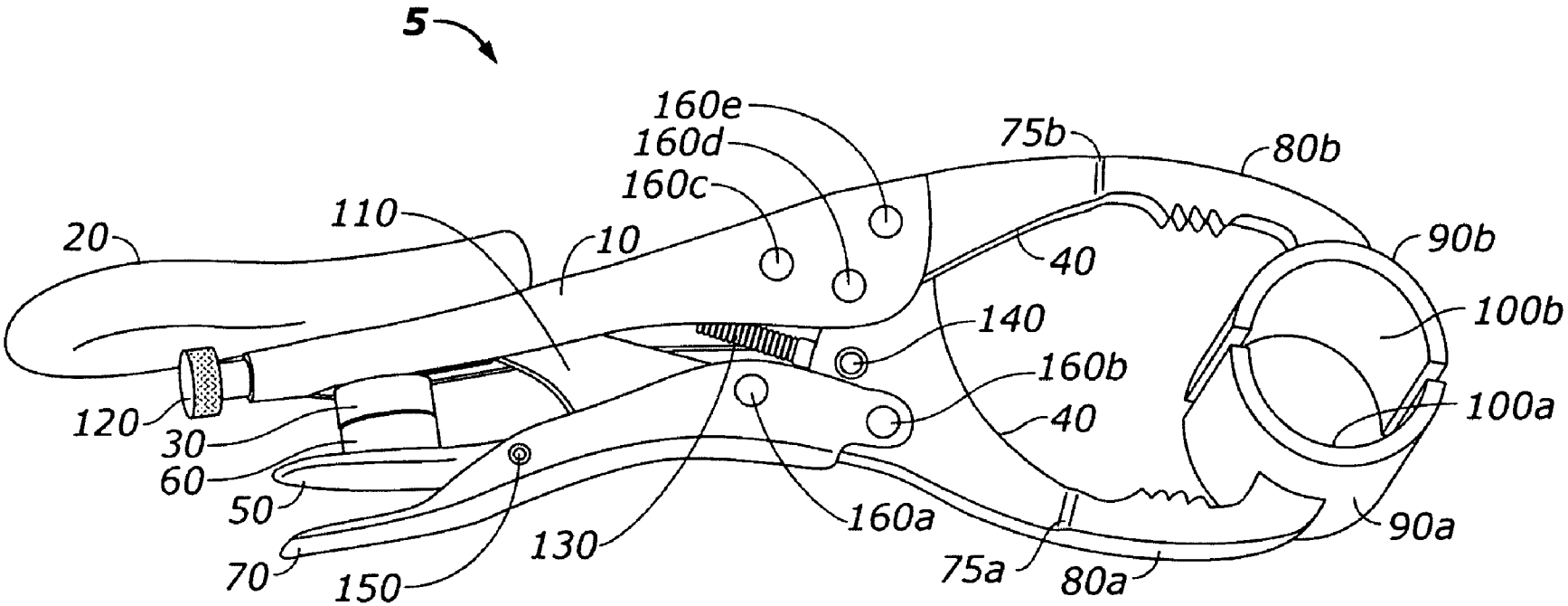
FIG. 3 represents a view of the clamping apparatus of FIG. 1 in a clamped position.

Disposed on the handle 10, as seen in FIG. 1, or any suitable location on the clamping apparatus 5 is a magnet 30. The magnet 30 provides a means for the handle 10 to be in contact with an element of the clamping apparatus 5, including a magnet contacting element 60, a release lever 50 or a secondary handle 70, such as to secure the clamping apparatus 5 in a clamping position, as shown in FIG. 3. As used herein, the clamping apparatus 5 may be in a "clamping position" when end portions 100*a*, 100*b* of clamping segments 80*a*, 80*b* (to be discussed in detail below) are in proximity to one another to grip, hold, and/or secure an object. Although depicted as round and having a flat surface, the magnet 30 may assume any conventional shape or orientation to be in contact with another portion of the clamping apparatus 5 to secure the clamping apparatus 5 in a clamping position. As shown, the magnet 30 is fixed on the inward surface of the handle 10 of the clamping apparatus 5. However, the present disclosure contemplates a magnet 30 located anywhere on the clamping apparatus 5 in order to contact any portion of the clamping apparatus 5 while in the clamping position. The magnet may be formed as part of the handle 10 or it may be fixed to the handle 10 by any suitable means such as by welding, adhesion, or similar fixing means. When in the clamping position as depicted in FIG. 3, magnetic force may maintain the clamping apparatus 5 in a clamped (i.e., locked) position until it is manually opened by applying pressure to the release lever 50. The additional security provided by the magnet may allow the clamping apparatus 5 of the present disclosure to securely hold and/or grip relatively heavy objects such as metal rods and axles.

Figure 2:
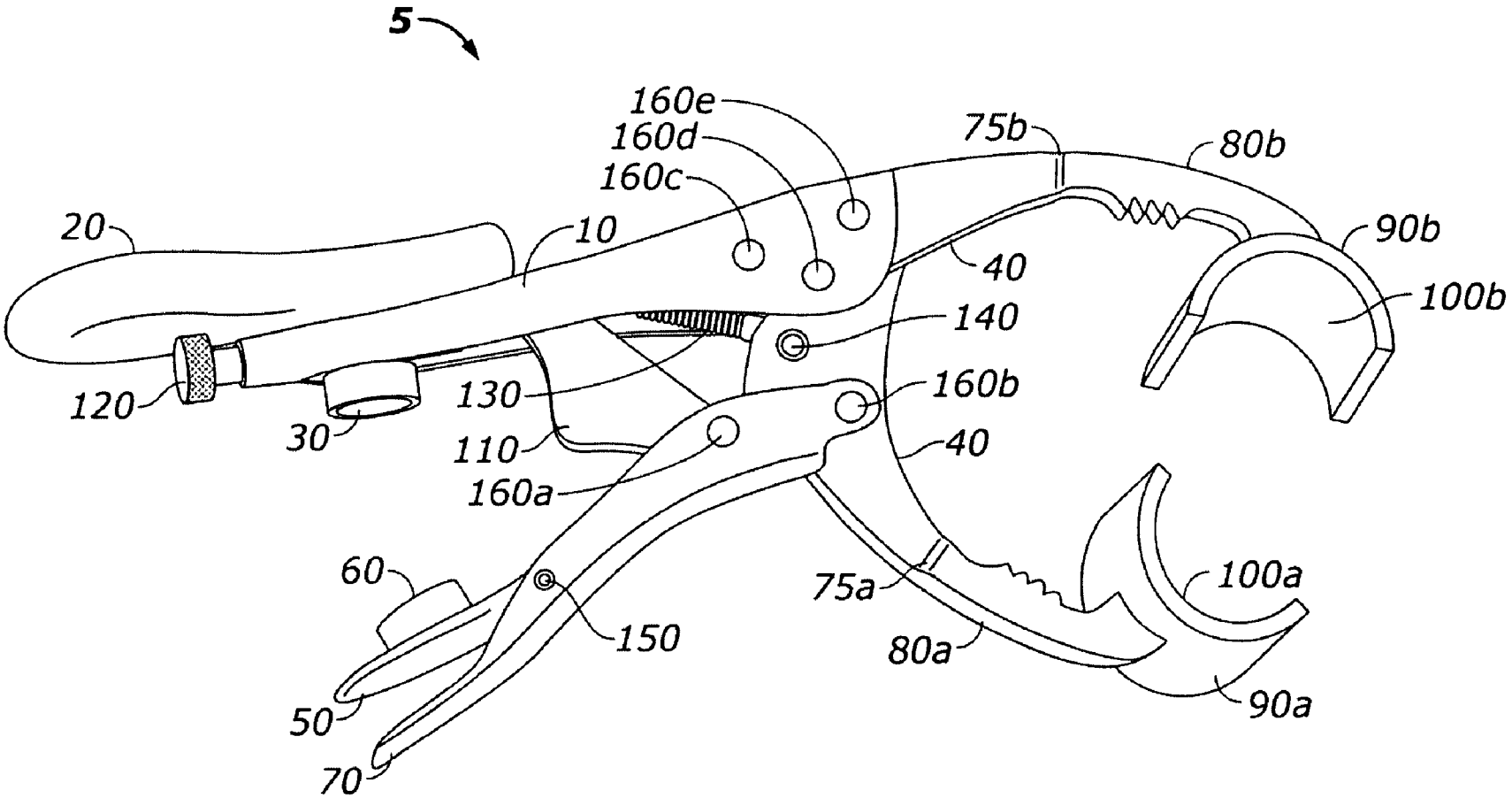
FIG. 2 represents a view of the clamping apparatus of FIG. 1 in an open position.

Turning to FIG. 2, the clamping apparatus 5 is depicted in an open position, in accordance with one aspect of the present disclosure. In the "open position" as shown, the magnet 30 is not in contact with the magnet contacting element 60, release lever 50, secondary handle 70, or any other portion of the clamping apparatus 5. Further, the open position of the clamping apparatus 5 is characterized by the end portions 100*a*, 100*b* of the clamp segments 80*a*, 80*b* being at a distance from each other so as to prevent the holding or gripping of an object by the end portions 100*a*, 100*b*.

As shown, the secondary handle 70 may be coupled, similarly to the handle 10, to the movable jaw 40 via a fastener 160*b*. Thus, movement of the secondary handle 70 may cause the movable jaw 40 to open or close. The movable jaw 40 opens when the clamping apparatus 5 moves towards the open position whereas the movable jaw 40 closes when the clamping apparatus 5 moves toward the clamped position. The secondary handle 70 may provide a magnet contacting element 60 directly on the secondary handle 70 or on the release lever 50 (described below), as shown, which is coupled to the secondary handle 70 via a lever linking element 150. The magnet contacting element 60 may be located on a protruding element as depicted in FIG. 2. However, the magnet contacting element 60 may exist on the flat surface of the release lever 50, secondary handle 70 or other portion of the clamping apparatus 5 to be contacted with the magnet 30. In one implementation, the magnet contacting element 60, as a protruding element, may be fixed on the inward surface of the secondary handle 70 of the clamping apparatus 5.

Depicted as part of the secondary handle 70 in FIG. 2, the release lever 50 may provide a means to disengage contact between the magnet 30 and magnet contacting element 60, such as in the closed position. The release lever 50 may be of a type generally known to those skilled in the art of handheld tools. Pressure may be applied to the end tip of the release lever 50 to release contact between the magnet 30 and magnet contacting element 60. To impart a pivot movement to the release lever 50, an elastic member (not shown), such as a spring, may couple the release lever 50 to an internal cavity of the secondary handle 70. Further, the release lever 50 is at closer proximity to the magnet 30 as compared to the secondary handle 70 and thus provides more easy in contacting the magnet 30 to a magnet contacting element 60 disposed on the secondary handle 70.

A linking element 110 may provide a means of coupling the handle 10 to the secondary handle 70 to allow movement of the secondary handle 70. Movement of the secondary handle 70 may in turn effectuate movement of the movable jaw 40 from a closed position to an open position, and vice versa. The linking element 110 may be coupled to the handle 10 and/or the secondary handle 70 via connecting means such as fastener 160*a*. The linking element 110 may provide a means to lock movement of the secondary handle 70, such as when the clamping apparatus is in the open position. In one implementation, a locking lever (not shown) in an internal cavity of the handle 10 or secondary handle 70 may prevent the movement or and lock the secondary handle 70 in place. According to another implementation, the internal cavity of the handle 10 or secondary handle 70 may define at least one groove (not shown) into which the linking element 110 may reside to prevent movement of the secondary handle 70. In locking the movement of the secondary handle 70, the linking element 110 may also enable the locking of the movable jaw 40. Further, the linking element 110 may collapse into the internal cavity of the secondary handle 70 to efficiently move the clamping apparatus 5 to a clamping position.

As depicted in FIGS. 1-3, the movable jaw 40 may comprise two clamp segments 80*a*, 80*b*. The clamp segments 80*a*, 80*b* may be portions of the movable jaw 40 or they may be separate elements coupled to the movable jaw 40 via hinges 75*a*, 75*b*. In the event the clamp segments 80*a*, 80*b* are attached via hinges 75*a*, 75*b*, an additional hinge fastener (not shown) may be utilized to lock movement of the hinges 75*a*, 75*b*. The hinge fastener may allow the clamp segments 80*a*, 80*b* to be pivoted at angles less than or greater than the angle of the movable jaw 40 and thus, allow versatility in the size of objects that can be held within the end portions 100*a*, 100*b*. In implementations whereby the movable jaw 40 and clamp segments 80*a*, 80*b* are formed from the same piece, i.e., without the hinges 75*a*, 75*b*, the movable jaw 40 and clamp segments 80*a*, 80*b* maintain a rigid and fixed form.

The end portions 100*a*, 100*b* provide contact between the clamping apparatus 5 and a held object (not shown). The end portions 100*a*, 100*b* may have a substantially semi-circular or semi-cylindrical cross-section, as shown in FIGS. 1-3. However, it is understood that the end portions 100*a*, 100*b* may have any conventional cross-sectional shape suitable to hold a particular object. The outer surface portions 90*a*, 90*b* are the surfaces not in contact with the object when it clamped by the clamping apparatus 5. Together, the end portions 100*a*, 100*b* and the outer surface portions 90*a*, 90*b* form a shaft support collar capable of clamping around a particular object by an inward movement of the handle 10 and secondary handle 70. The shaft support collar may be formed from the same pieces as the clamp segments 80*a*, 80*b* or it may be a separate portion of the clamping apparatus 5 affixed by any reasonable means such as welding, fastening (e.g., via screws, nuts, bolts) or the like.

Also coupled to or formed from the handle 10 is a loop portion 20 defining a hole 25. The loop portion 20 serves as a means to hang the clamping apparatus 5 for ease of access, storage or display when not in use. In implementations whereby the loop portion 20 is affixed to the clamping apparatus 5, any reasonable means of fixing the loop portion 20 to the handle 10 may be contemplated such as by welding, fastening (e.g., via nut, bolt), or the like. In other implementations, an end of the loop portion 20 may be affixed to the handle 10 still allowing extension of the loop portion 20 (e.g., via wire) to allow hanging of the clamping apparatus 5 when not in use.

As depicted in FIGS. 1-3, coupled to a terminal end of the handle 10 is an adjustment component 120. The adjustment component 120 may comprise a threaded screw engaged on the terminal end of the handle 10 within a threaded aperture. In some implementations, the end of the screw may be engaged with a toggle link. By rotating the screw, the position of the toggle link may be altered, thereby providing more or less relative force between the handle 10 and the movable jaw 40. Thus, the adjustment component 120 may alter the level of tightness or looseness of the movement of the secondary handle 70 and/or moveable jaw 40.

Elements of the present disclosure may include a magnet to secure the clamping apparatus in a clamping position while a release lever provides an efficient means to release the clamping apparatus from a clamping to an open position. In industries, such as the automotive manufacturing industry, for example, clamping apparatus of the present disclosure may provide efficiency in securely gripping heavy objects, particularly during an assembly process.

Although the present disclosure has been described with reference to particular examples, embodiments and/or implementations, those skilled in the art will recognize that modifications and variations may be made without departing from the spirit and scope of the claimed subject matter. Such changes in form and detail, including use of equivalent functional and/or structural substitutes for elements described herein, fall within the scope of the appended claims and are intended to be covered by this disclosure.

What is claimed is:

1. A clamping apparatus comprising:
- a first handle defining a hole;
- a magnet affixed to the first handle;
- a movable jaw coupled to the first handle and a second handle, the jaw comprising two clamp segments; and
- a magnet contacting element disposed on a release lever on the second handle, wherein pressure is applied to the release lever to disengage contact between the magnet contacting element and the magnet, allowing the clamping apparatus to return to an open position.

2. The apparatus of claim 1, wherein each of the two clamp segments comprise an end portion with a substantially semi-circular cross-sectional surface.

3. The apparatus of claim 1, wherein the magnet contacting element is disposed on a protruding element on the release lever.

4. The apparatus of claim 1, wherein an end portion of each of the two clamp segments is affixed to the movable jaw via a hinge.

5. The apparatus of claim 4, wherein the hinge is capable of pivoting each of the two clamp segments from a first position to a second position.

6. The apparatus of claim 1 further comprising a linking element connecting the first handle to the second handle, the linking element to enable locking of the movable jaw.

7. A clamping apparatus comprising:
- a first handle defining a hole;
- a magnet affixed to the first handle to secure the clamping apparatus in a clamping position;
- a movable jaw coupled to the first handle, the jaw comprising two clamp segments, wherein each of the two clamp segments comprise an end portion with a substantially semi-circular cross-sectional surface; and
- a release lever coupled to the movable jaw, the release lever in contact with the magnet via a magnet contacting element in the clamping position and wherein pressure is applied to the release lever to disengage the magnet contacting element from contacting the magnet when the clamping apparatus is in an open position.

8. The apparatus of claim 7 further comprising a second handle coupled to the release lever and the movable jaw, wherein movement of the second handle causes the opening or closing of the movable jaw.

9. The apparatus of claim 7, wherein each of the two clamp segments comprise an end portion with a substantially semi-circular cross-sectional surface.

10. The apparatus of claim 7, wherein a magnet contacting element is disposed on the release lever.

11. The apparatus of claim 7, wherein a magnet contacting element is disposed on a protruding element on the release lever.

12. The apparatus of claim 7, wherein an end portion of each of the two lamp segments is affixed to the movable jaw via a hinge.

13. The apparatus of claim 12, wherein the hinge is capable of pivoting each of the two clamp segments from a first position to a second position.

14. The apparatus of claim 7 further comprising a linking element connecting the first handle to the second handle, the linking element to enable locking of the movable jaw.

15. A clamping apparatus comprising:
- a first handle defining a hole;
- a magnet affixed to the first handle;
- a movable jaw coupled to the first handle and a second handle, the jaw comprising two clamp segments; and
- a magnet contacting element disposed on a release lever on the second handle, wherein the magnet contacting element is engaged with the magnet to secure the clamping apparatus in a clamping position, the release lever used to disengage the magnet contacting element from the magnet to return the clamping apparatus to an open position.

16. The clamping apparatus of claim 15, wherein the release lever disengages the magnet from the magnet contacting element upon pressure applied to the release lever.

17. The clamping apparatus of claim 15, wherein each of the two clamp segments comprise an end portion with a substantially semi-circular cross-sectional surface.

18. The apparatus of claim 15, wherein the magnet contacting element is disposed on a protruding element on the release lever.

19. The apparatus of claim 15, wherein an end portion of each of the two clamp segments is affixed to the movable jaw via a hinge, the hinge is capable of pivoting each of the two clamp segments from a first position to a second position.

20. The apparatus of claim 15 further comprising a linking element connecting the first handle to the second handle, the linking element to enable locking of the movable jaw.

* * * * *